United States Patent [19]

Sugouchi

[11] Patent Number: 4,693,230

[45] Date of Patent: Sep. 15, 1987

[54] ARCHERY BOW HANDLE RISER

[75] Inventor: Akira Sugouchi, Hamamatsu, Japan

[73] Assignee: Nippon Gakki Seizo Kabushiki Kaisha, Japan

[21] Appl. No.: 816,194

[22] Filed: Jan. 6, 1986

[30] Foreign Application Priority Data

Jan. 11, 1985 [JP] Japan ..... 60-001958[U]
Jan. 11, 1985 [JP] Japan ..... 60-002929

[51] Int. Cl.[4] ..... F41B 5/00

[52] U.S. Cl. ..... 124/88; 124/23 R; 264/279.1

[58] Field of Search ..... 124/88, 23 R, 24 R; 273/77 A, 72 A, 67 R

[56] References Cited

U.S. PATENT DOCUMENTS 2,228,823 1/1941 Helm ..... 124/23 R
3,801,098 4/1974 Gildemeister ..... 273/72 A
4,056,267 11/1977 Krieger ..... 273/72 A

*Primary Examiner*—Richard C. Pinkham
*Assistant Examiner*—Gary Jackson
*Attorney, Agent, or Firm*—Ostrolenk, Faber, Gerb & Soffen

[57] ABSTRACT

In construction of an archery bow, presence of an additional connecting mechanism in the region of the handle riser astride the grip well prevents uncontrolled jump of the broken piece at accidental breakage of the archery bow at the handle riser thereby assuring the utmost safety of archers. The riser has a core encased in an FRP shell. In one embodiment, an elongated connector extends through the core and has its ends connected to the shell. In a second embodiment, the core has an elongated recess near each end and the shell has a projection slidably positioned in each slot.

3 Claims, 7 Drawing Figures

ARCHERY BOW HANDLE RISER

BACKGROUND OF THE INVENTION

The present invention relates to an improved archery bow handle riser and a method for producing the same, and more particularly relates to an improvement in safety of an archery bow handle riser including a FRP shell and its production.

In general, the handle riser of an archery bow is made of materials such as FRP (fiber reinforced plastics) and light metals. Regardless of the materials used for production, the archery bow is apt to break near the pivot point on the grip at the end of its life caused by fatigue and/or corrosion of the material. When such breakage occurs, the broken half of the archery bow, in particular the one not gripped by the archer's hand, tends to jump towards the archer with a risk of hurting the archer.

In order to avoid such a risk, it is best to estimate the end of life of an archery bow handle riser. In practice, however, it is quite infeasible to correctly estimate the end of life of an archery bow handle riser which is greatly swayed by various factors such as manner of use by the archer, inherent strength of the archery bow, choice of strings and arrows, frequency of use, manner and condition of storage, degree of maintenance and climatic conditions. That is, there is no established standard for estimation of life.

It is already proposed with an archery bow including a cast handle riser made of Mg alloys to connect sections on both sides of the grip with a hand or the like for archer's safety at breakage. When the handle riser breaks at shooting, however, elastic recovery of the limb rotates the broken half which is liable to jump towards the archer. So, no reliable safety is assured by this earlier proposal.

An archery bow handle riser having a cavitious FRP shell is also known but, in the case of this type, no safety at breakage is taken into consideration.

SUMMARY OF THE INVENTION

It is the basic object of the present invention to provide an archery bow handle riser with the utmost safety at breakage.

In accordance with the present invention, an elongated connector is accommodated within and coupled to a FRP shell and the connector extends in the longitudinal direction of the grip of an archery bow handle riser.

In accordance with the present invention, such a connector is placed in position at formation of a crude handle riser.

Figure 1:
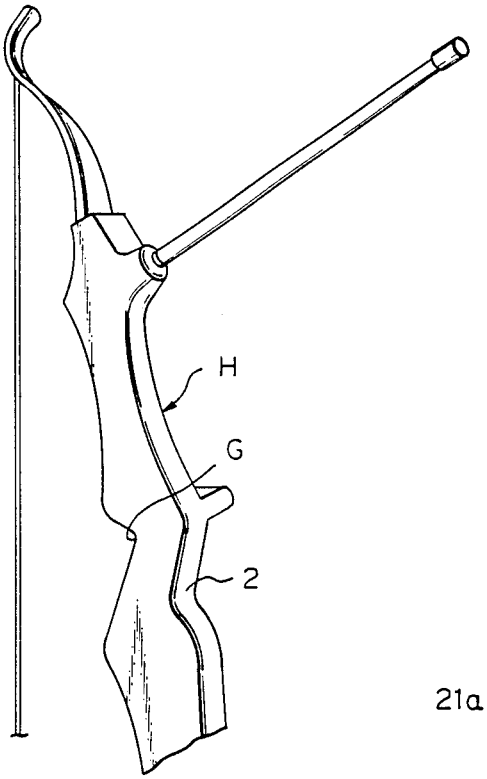
FIG. 1 is a perspective view of one example of the archery bow handle riser to which the present invention is applicable.

The main part of an archery bow to which the present invention is applied is shown in FIG. 1, in which a handle riser H includes a FRP shell 2 located in the vicinity of a grip G.

Figure 2:
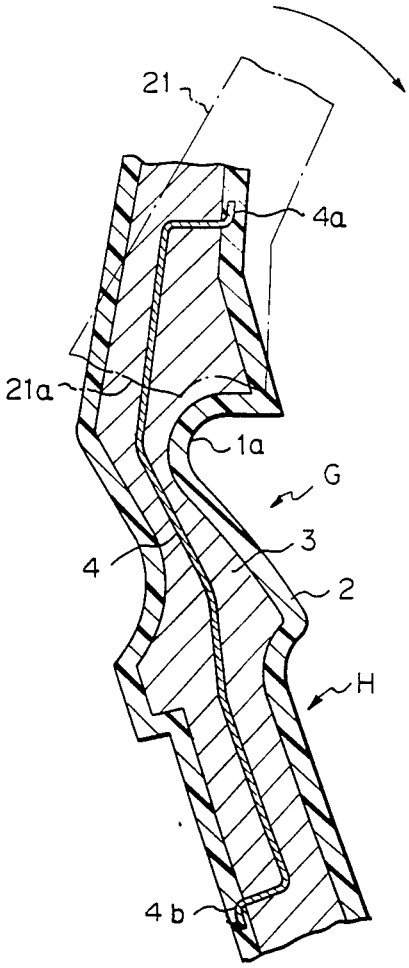
FIG. 2 is a side sectional view of one embodiment of the archery bow handle riser in accordance with the present invention.

One embodiment of the handle riser H in accordance with the present invention is shown in FIG. 1, in which a separate connector is employed. As shown in FIG. 2, a core 3 made of foam resin is accommodated in the FRP shell 2 and an elongated connector 4 is embedded in and extends in the longitudinal direction of the grip G of the handle riser H. The connector 4 is made of a high tensional, flexible strap or wire. Ends 4*a*, 4*b* of the connector 4 are double-hooked outwards and secured to the FRP shell 2.

When the handle riser H is accidentally broken at shooting, a broken piece 21, which is shown with chain lines in FIG. 2, is connected to the grip G of the handle riser H via the connector 4 so that the broken end 21*a* of the broken piece 21 should not jump towards the archer.

Figure 3:
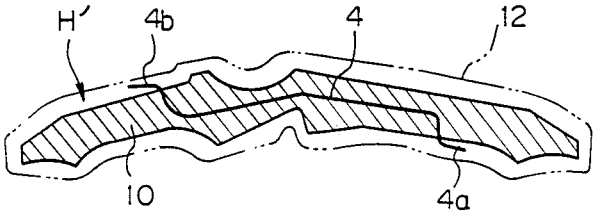
FIGS. 3 to 5 show one example of production of the archery bow handle riser shown in FIG. 2.
Figure 4:
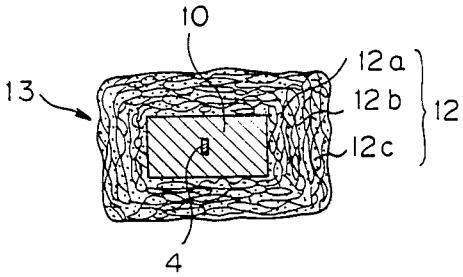

At production of such a handle riser, the connector 4 is embedded in a foam resin crude core 10 whose configuration is roughly patterned after the handle riser H as shown in FIG. 3. The both ends 4*a* and 4*b* of the connector 4 are exposed outside the crude core 10. Next, a crude FRP shell 12 such as prepreg is applied to the surface of the crude core 10 at least to an extent that ends 4*a* and 4*b* of the connector 4 should be wholly covered to form a crude handle riser H'. One example of the crude FRP shell 12 is shown in FIG. 4 in which the crude FRP shell 12 has a three-layer construction. For example, the inner layer 12*a* contains rovings of glass fibers, the intermediate layer 12*b* contains glass or carbon fiber cloths, and the outer layer 12*c* contains carbon fiber rovings.

Figure 5:
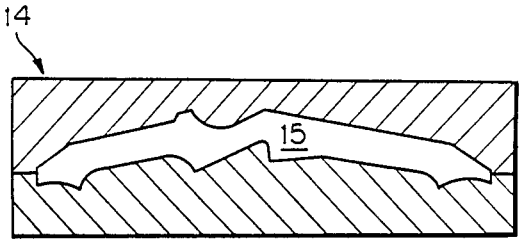

The crude handle riser H' so prepared is then placed in the cavity 15 of a mould 14 such as shown in FIG. 5 for application of heat under pressure. During this heating under pressure, the ends 4*a* and 4*b* of the connector 4 are firmly secured to the FRP shell 2.

At application of the crude FRP shell 12, various attachments such as balance weights and reinforcing members may be concurrently attached. Similarly, holes for attachment of stabilizers may be also formed at this stage of production.

Although foam synthetic resin is used for the core 3, an air bag may be used for the crude core in order to provide a cavitious core. In this case, the connector 4 is arranged along the outer surface of the crude core 10 and the connector 4 is covered with a proper cover in order to prevent resin penetration except for the ends 4*a* and 4*b*. The ends 4*a* and 4*b* may be fixed at proper positions on the crude handle riser H' and they may be wound around the crude core 10. For the connector 4, leather, rubber, rovings made of glass fibers or long fibers such as nylon and wires of 0.5 to 5 mm diameters may be used.

Figure 6:
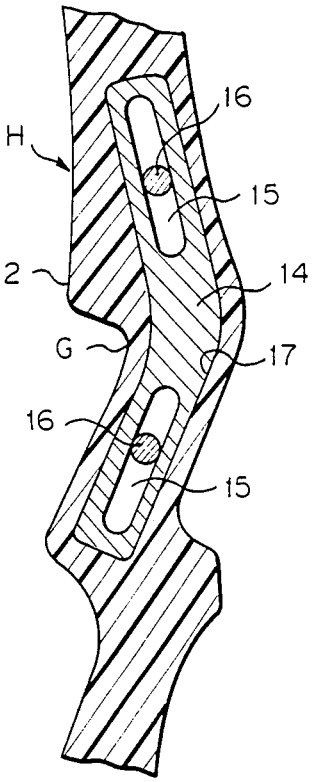
FIG. 6 is a side sectional view of another embodiment of the archery bow handle riser in accordance with the present invention.
Figure 7:
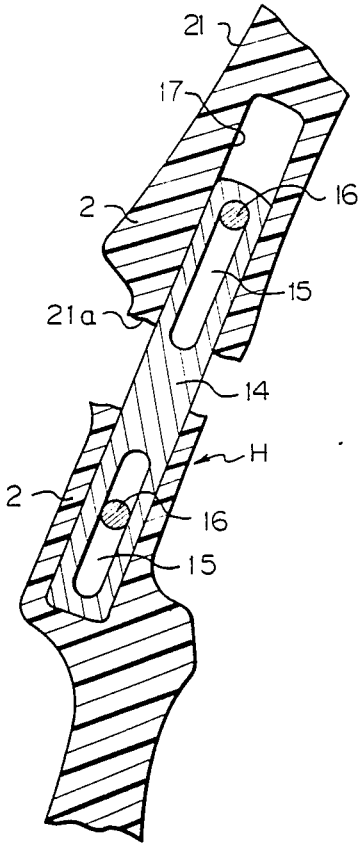
FIG. 7 is a side sectional view of the archery bow handle riser shown in FIG. 6 at breakage.

Another embodiment of the handle riser H in accordance with the present invention is shown in FIG. 6, in which a core is used as a connector. More specifically, a core 14 is encased in a slot 17 extending in the longitudinal direction of the handle riser H astride the grip G. On both longitudinal sides of the grip G, the core 14 is provided with slots 15 and each slot 15 freely receives a projection 16 formed integrally with the FRP shell 2.

When the handle riser H is accidentally broken at shooting, the broken piece 21 slides upwards on the core 14 until the associated projection 16 abuts against the upper end of the upper slot 15 in the core 2 and further sliding of the broken piece 21 is blocked by this abutment so that the broken end 21*a* of the broken piece 21 should not jump towards the archer.

The material used for the core 14 of this embodiment should readily endure the force to be applied thereto at breakage of the handle riser H. Although it may have some degree of resilience, it should be rigid enough to prevent jump of the broken end 21*a* at breakage.

As a substitute for the core 14, a proper strap may be encased within the slot 17 of the FRP shell with its ends secured near the ends of the slot 17 with some slack on the strap. Further, simple recesses receptive of the projections may be formed in the core instead of the slots. However, the slots alleviate shock at breakage.

In accordance with the present invention, the section of the handle riser is connected to the remainder of the handle riser by an additional connecting mechanism which prevents lurch of the broken piece towards the archer at accidental breakage of the handle riser, thereby assuring the utmost safety to archers.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

I claim:

1. An improved archery bow having a grip, comprising:

a handle riser including an FRP shell and a core encased by said FRP shell; and an elongated connector extending through said core in the longitudinal direction of said handle riser for a length of said grip and secured at both ends to said FRP shell.

2. An improved archery bow having a grip, comprising:

a handle riser including an FRP shell, said shell having a slot extending through it in the longitudinal direction of said handle riser;

a core freely encased in said slot and extending in said slot for a length of said grip, said core having a respective recess at each side of said grip along said longitudinal direction; and a pair or projections formed integrally with said FRP shell and each projection being freely received in a respective one of said recesses in said core.

3. An improved archery bow as claimed in claim 2 in which each said recess is a slot extending in the longitudinal direction of said core.

* * * * *